US008056607B2

(12) United States Patent
Garlock et al.

(10) Patent No.: US 8,056,607 B2
(45) Date of Patent: Nov. 15, 2011

(54) METHOD OF CASTING METAL ARTICLES

(75) Inventors: Robert M. Garlock, Chardon, OH (US); Gary J. Vanek, Chardon, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 15 days.

(21) Appl. No.: 12/768,314

(22) Filed: Apr. 27, 2010

(65) Prior Publication Data

US 2010/0206511 A1 Aug. 19, 2010

Related U.S. Application Data

(63) Continuation of application No. 12/145,033, filed on Jun. 24, 2008.

(51) Int. Cl.
*B22D 27/04* (2006.01)

(52) U.S. Cl. ..... 164/122; 164/122.1; 164/126; 164/128

(58) Field of Classification Search ..... 164/122–122.2, 164/126, 128
See application file for complete search history.

(56) References Cited

U.S. PATENT DOCUMENTS 2,462,255 A 2/1949 Charman et al.
3,763,926 A 10/1973 Tschinkel et al.
3,810,504 A * 5/1974 Piwonka ..... 164/122.1
4,106,905 A * 8/1978 Schmitt et al. ..... 422/41
4,108,236 A 8/1978 Salkeld
4,190,094 A * 2/1980 Giamei ..... 164/122.1
4,430,121 A 2/1984 Shima
5,778,961 A 7/1998 Hugo et al.
5,988,257 A 11/1999 Hugo
6,035,924 A 3/2000 Graham
6,085,827 A 7/2000 Hugo
6,276,433 B1 8/2001 Gigliotti, Jr. et al.
6,308,767 B1 10/2001 Hugo et al.
6,311,760 B1 11/2001 Ferinhough et al.
6,343,641 B1 2/2002 Gigliotti, Jr. et al.
6,367,538 B1 4/2002 Ghosh et al.
6,446,700 B1 9/2002 Klug
6,695,034 B2 2/2004 Graham

* cited by examiner

*Primary Examiner* — Jessica L Ward
*Assistant Examiner* — Kevin E Yoon
(74) *Attorney, Agent, or Firm* — Tarolli, Sundheim, Covell & Tummino LLP

(57) ABSTRACT

A method of casting metal articles includes providing a plurality of interconnected support sections. Article mold sections are positioned on the support sections. After article mold cavities, have been filled with a molten metal which is at a first temperature, the support sections and a body of a second molten metal are moved relative to each other while the body of a second molten metal is at a temperature which is less than the first temperature. Space extending between side surfaces of the support sections and between side portions of the article mold sections is filled with the second molten metal during movement between the support sections and the body of a second molten metal. A layer of insulating material may be provided above the body of a second molten metal. A baffle may be provided between a container holding the body of a second molten metal and a furnace assembly.

12 Claims, 4 Drawing Sheets

METHOD OF CASTING METAL ARTICLES

RELATED APPLICATION

This application is a continuation of U.S. patent application Ser. No. 12/145,033 filed Jun. 24, 2008. The benefit of the earlier filing date of the aforementioned application Ser. No. 12/145,033 is hereby claimed. The disclosure in the aforementioned application Ser. No. 12/145,033 is hereby incorporated herein in its entirety by this reference thereto.

BACKGROUND OF THE INVENTION

The present invention relates to the cooling of molten metal in a mold with a body of a molten metal which is at a lower temperature than the molten metal in the mold.

It has previously been suggested that a casting furnace may employ a body of molten metal as a bath to promote directional solidification of an article in a mold. One apparatus for doing this is disclosed in U.S. Pat. No. 6,308,767. It has also been suggested that a plurality of articles may be floated on a body of molten metal forming a bath so as to form an insulating layer which extends across an upper surface of the bath. One apparatus for doing this is disclosed in U.S. Pat. No. 6,446,700.

SUMMARY OF THE INVENTION

The present invention relates to a new and improved method of casting metal articles. The method includes providing a support structure having a plurality of support sections. Article mold sections are positioned on the support sections. Article mold cavities in the article mold sections are filled with a first molten metal which is at a first temperature.

The support sections and a body of a second molten metal are moved relative to each other. The body of a second molten metal is at a temperature which is less than the first temperature of the first molten metal in the article mold cavities. Spaces extending between side surfaces of the support sections and between side portions of the article mold sections are filled with the second molten metal.

If desired, a layer of insulating material may be provided above an upper side of the body of a second molten metal. Portions of the layer of insulating material are aligned with spaces extending between side surfaces of the support sections. These portions of the layer of insulating material extend across space between the support sections and extend across space between portions of the article mold sections during at least a portion of the relative movement between the support sections and body of molten metal. A baffle may be provided between a container holding the body of a second molten metal and a furnace assembly.

The present invention has a plurality of different features which are advantageously utilized together in the manner described herein. However, it is contemplated that the features may be utilized separately and/or in combination with features from the prior art.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
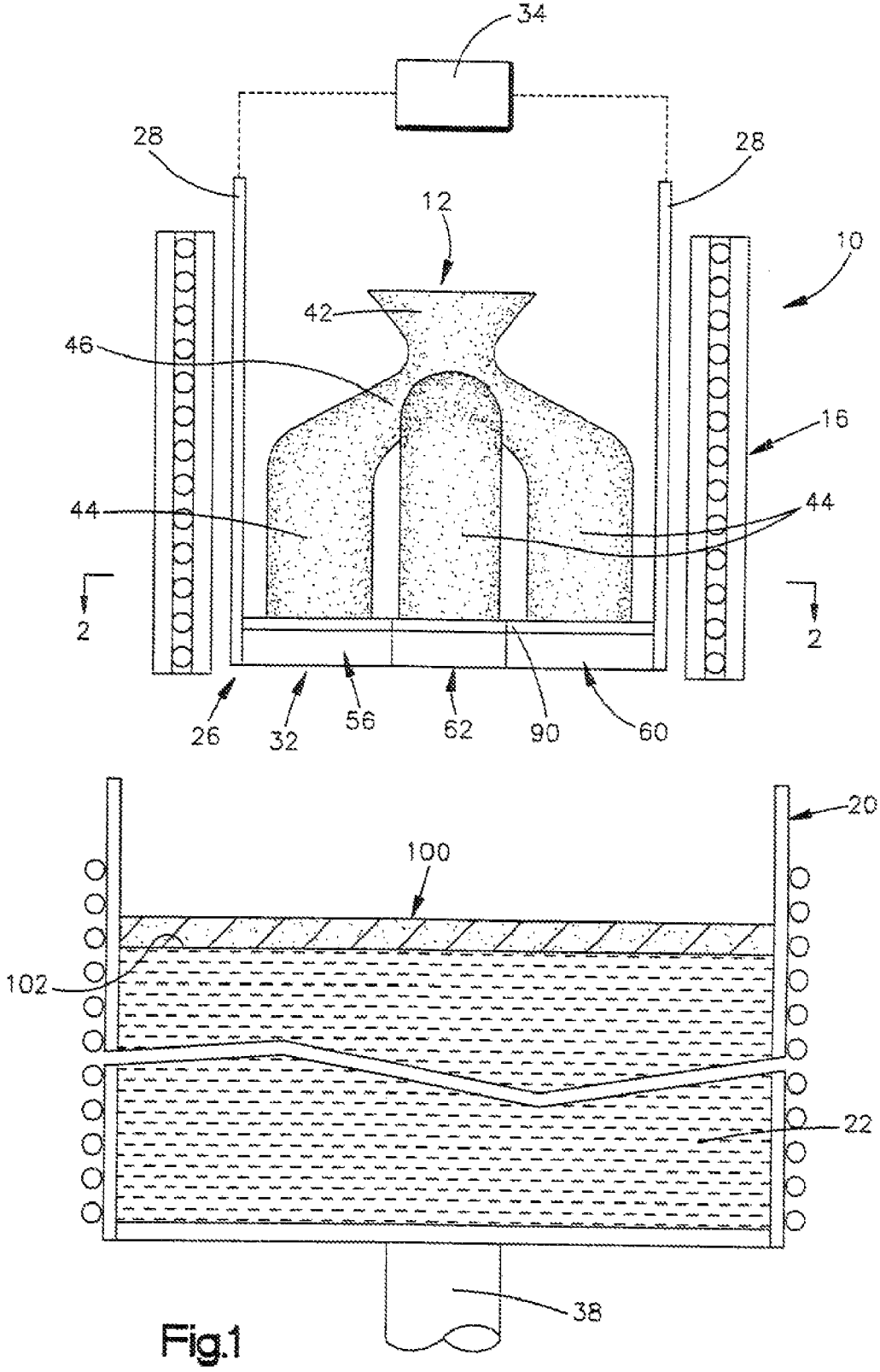
FIG. 1 is a schematic illustration depicting the relationship between a support structure and a mold structure when the mold structure is disposed above a body of molten metal.

A casting apparatus 10 is illustrated schematically in FIG. 1 and is utilized in an improved method of casting metal articles in a mold structure 12. The casting apparatus 10 includes a furnace assembly 16 in which a first molten metal is poured into the ceramic mold structure 12 in a known manner. Directly beneath the furnace assembly 16 is a container 20 which holds a bath or body 22 of a second molten (liquid) metal. The casting apparatus 10 is enclosed by a suitable housing (not shown) which is connected with a source of vacuum or low pressure by conduits.

The housing enables an evacuated atmosphere to be, maintained around the furnace assembly 16 and container 20 holding the bath or body 22 of molten metal. The housing may have any one of many known constructions, including the construction disclosed in U.S. Pat. No. 3,841,384 and/or the construction shown in U.S. Pat. No. 6,308,767. Of course, the housing may have a construction which is different than the known constructions illustrated in the aforementioned patents.

An improved framework 26 (FIG. 1) is provided to support the mold 12 for movement to and from the furnace assembly 16 and for movement to and from the body 22 of molten metal. The metal framework 26 includes a plurality of parallel support rods 28 and a mold support structure 32. The support structure 32 functions as, and may be referred to as, a chill plate.

The support rods 28 are connected with an upper drive assembly 34 and with the mold support structure 32. The upper drive assembly 34 is operable to raise and lower the framework 26 relative to the furnace assembly 16 and container 20 holding the body 22 of molten metal. If desired, the support rods 28 may be disposed outside the furnace assembly 16.

A lower drive assembly 38 is connected with the container 20 which holds the body 22 of molten metal. The lower drive assembly 38 is operable to raise and lower the container 20 relative to the furnace assembly 16. The upper and lower drive assemblies 34 and 38 may be operated simultaneously and/or sequentially to raise and/or lower the framework 26 and/or container 20 holding the body 22 of molten metal.

During operation of the casting apparatus 10, the one piece ceramic mold structure 12 is supported in the furnace assembly 16 by the framework 26. The mold structure 12 is disposed on the support structure 32 forming the base of the framework 26. The mold structure 12 may be connected to the support structure 32 by suitable clamps and/or fasteners.

Heat is transmitted from the mold structure 12 to the metal support structure 32 which functions as a chill plate. The mold structure 12 is raised and lowered relative to the furnace assembly 16 by operation of the upper drive assembly 34 which is connected to the support structure 32 by the support rods 28. If desired, a flow of cooling liquid may be conducted through the support structure 32. It is contemplated that the support structure 32 may be constructed so as to be located outside the furnace assembly 16.

While the mold structure 12 is supported in the furnace assembly 16 on the framework 26, in the manner illustrated schematically in FIG. 1, the mold structure is preheated to a desired temperature. Molten metal is then poured into a pour cup 42 which is connected with article molds 44 in the mold structure 12 by a gating system 46. The illustrated mold structure 12 is of a one-piece ceramic construction. However, the mold structure 12 may be formed by two or more pieces and may have a construction other than a ceramic construction.

The mold structure 12 has a construction which is generally similar to the construction disclosed in U.S. Pat. Nos. 5,048,591; 5,062,468; and/or 5,072,771. The mold structure 12 is utilized to cast turbine engine components. However, it should be understood that the mold structure 12 may have a construction which is different than the construction which is disclosed in the aforementioned patents and/or may be used to cast articles other than turbine engine components.

The mold structure 12 is filled with molten liquid metal while the mold structure is in the furnace assembly 16. The molten metal with which the mold structure 12 is filled is a molten nickel-chrome super alloy which melts at a temperature which is greater than 3,000 degrees Fahrenheit. Of course, the mold structure 12 may be filled with a different molten metal which melts at a different temperature. For example, the mold structure 12 may be filled with molten titanium or a titanium alloy.

Once the mold structure 12 has been filled with the molten nickel-chrome super alloy or other metal, the upper drive assembly 34 is operated to lower the framework 26 and mold structure 12 into the body 22 of a second molten metal in the container 20. While the upper drive assembly 34 is operated to lower the mold structure 12, the lower drive assembly 38 may be operated to raise the body 22 of liquid metal. It should be understood that the mold structure 12 may be immersed in the body 22 of molten metal by lowering the support structure 32 without raising the body 22 of molten metal. Alternatively, the furnace assembly 16 may be raised relative to the mold structure 12 and the body 22 of molten metal raised relative to the mold structure to immerse the mold structure in the body of molten metal. Although either one of the mold structure 12 and body 22 of molten metal may be moved relative to the other to effect immersion of the mold structure 12 in the body 22 of molten metal, it may be desired to both raise the body 22 of molten metal and lower the mold structure 12.

The molten super alloy in the mold structure 12 is at a temperature above 3,000 degrees Fahrenheit. The body 22 of molten metal is at a temperature below 1,000 degrees Fahrenheit. The resulting temperature differential between the molten metal in the mold structure 12 and the molten metal in the body 22 of molten metal results in directional solidification of the molten metal in the mold structure 12 as the mold structure is immersed in the body 22 of molten metal. The molten metal in the mold structure 12 may solidify with either a columnar grain crystallographic structure or with a single crystal crystallographic structure.

In the illustrated embodiment of the invention, the body 22 of molten metal is formed of tin and is at a temperature of approximately 500 degrees Fahrenheit. However, the body 22 of molten metal may be formed of lead or aluminum if desired. The molten metal in the mold structure 12 is a nickel-chrome super alloy with a melting temperature which may be approximately 3,700 degrees Fahrenheit. Of course, a different molten metal may be poured into the mold structure 12.

It should be understood that the specific temperatures for the body 22 of molten metal and the molten metal in the mold structure 12 will vary depending upon the composition of the metal. For example, the body 22 of molten metal may be any one of many metals which is liquid (molten) at a temperature below 1,500 degrees Fahrenheit. The molten metal in the mold structure 12 may be any one of many different metals which melt at a temperature above 2,000 degrees Fahrenheit.

The greater the temperature differential between the temperature of the molten metal in the mold structure 12 and the body 22 of molten metal, the greater will be the rate at which heat is withdrawn from the molten metal in the mold structure as the mold structure is immersed into the body of molten metal. Of course, the rate of transfer of heat from the molten metal in the mold structure 12 to the body 22 of molten metal will also vary as a function of the rate at which the mold structure and body of molten metal are moved relative to each other by the upper and/or lower drive assemblies 34 and 38.

Support Structure

The support structure 32 is constructed so as to minimize agitation of the body 22 of molten metal as the support structure and mold structure 12 are immersed in the body 22 of molten metal. In addition, the support structure 32 is constructed so as to enable the mold structure 12 to be readily withdrawn from the body 22 of molten metal with minimal adherence of liquid metal to the support structure 32 and/or mold structure 12.

Figure 2:
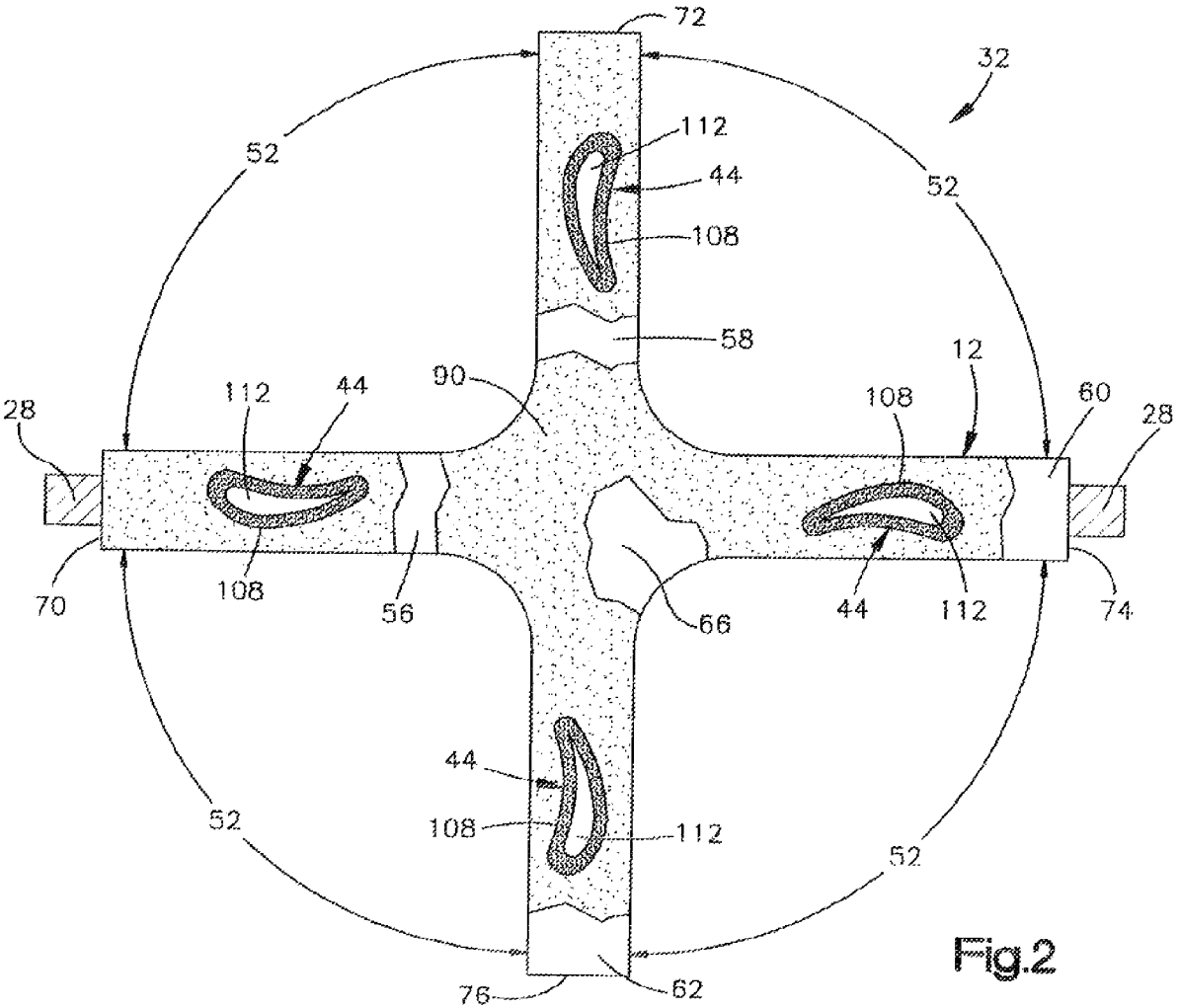
FIG. 2 is an enlarged schematic illustration, taken generally along the line 2-2 of FIG. 1, further illustrating the relationship of the mold structure to the support structure.

The support structure 32 is constructed so as to have open space, indicated by arrows 52 in FIG. 2, between sections of the support structure and between article mold sections 44 of the mold structure 12. The open spaces 52 in the support structure 32 and the mold structure 12 enables the mold structure to be moved into the body 22 (FIG. 1) of molten metal with minimal disturbance of the body of molten metal. When the mold structure 12 and support structure 32 are withdrawn from the body 22 of molten metal, the open spaces in the mold structure and support structure facilitate separation of the molten metal in the body 22 of molten metal from both the mold structure 12 and the support structure 32.

In the illustrated embodiment of the invention, the support structure 32 has a generally X-shaped configuration. Thus, the support structure 32 includes support sections 56, 58, 60, and 62 (FIG. 2). The support sections 56 and 60 have coincident longitudinal central axes. The support sections 58 and 62 have coincident longitudinal central axes which extend perpendicular to the longitudinal central axes of the support sections 56 and 60. The support sections 56-62 have rectangular cross sectional configurations (FIG. 3), as viewed in planes extending perpendicular to the longitudinal central axes of the support sections.

The support sections 56-62 are interconnected at a central portion 66 (FIG. 2) of the support structure 32. The support structure 32 may be integrally formed from one piece of material. Alternatively, the support structure 32 may be formed of a plurality of separate pieces of material which are interconnected by the central portion 66 of the support structure. The support structure 32 is formed of 304 stainless steel. However, the support structure 32 may be formed of a different material if desired. For example, the support structure 32 may be formed of a ceramic material.

Although the illustrated embodiment of the support structure 32 includes four support sections 56-62, it should be understood that the support structure 32 may have a greater or lesser number of support sections if desired. It should also be understood that although the support sections 56-62 extend at right angles to adjacent support sections, a different angle may be provided between the support sections if desired. The support sections 56-62 may have a different configuration than the illustrated configuration. For example, the support sections may flare outwardly from the central portion 66 of the support sections to outer end surfaces 70, 72, 74 and 76. Although the illustrated outer end surfaces 70-76 have the same rectangular configuration, the end surfaces 70-76 may have a different configuration if desired.

Figure 3:
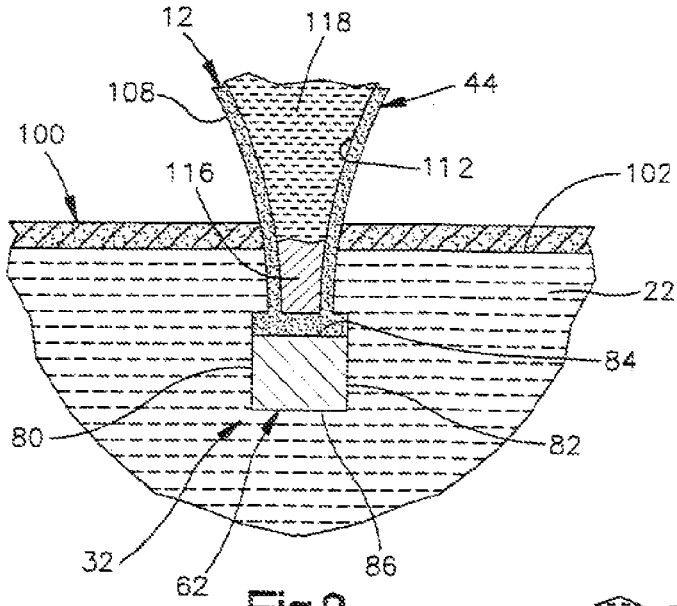
FIG. 3 is an enlarged fragmentary schematic illustration depicting the manner in which a portion of the support structure and a portion of the mold structure enters the body of molten metal on which a layer of insulating material is disposed.

The rectangular cross sectional configuration of the support section 62 is illustrated in FIG. 3. The support section 62 includes parallel side surfaces 80 and 82. Upper and lower surfaces 84 and 86 extend parallel to each other and are perpendicular to the side surfaces 80 and 82. Although the cross sectional configuration of only the support section 62 has been illustrated in FIG. 3, the support sections 56, 58 and 60 have the same rectangular cross sectional configuration as the support section 62.

The upper surface 84 on the support section 62 is disposed in a coplanar relationship with and has the same configuration as the upper surfaces on the support sections 56, 58, and 60. Similarly, the lower surface 86 of the support section 62 is coplanar with and has the same configuration as the lower surfaces on the support sections 56, 58 and 60. Although the upper surfaces 84 on the support sections 56-62 are disposed in a coplanar relationship, one or more of the upper surfaces may be offset from one or more of the other upper surfaces. Similarly, one or more of the lower surfaces may be offset from one or more of the other lower surfaces.

In one specific embodiment of the support structure 32, the distance from the end surface 70 (FIG. 2) on the support section 56 to the end surface 74 on the support section 60 was approximately 78 inches. In this specific embodiment of the support structure 32, the distance from the end surface 72 on the support section 58 to the end surface 76 on the support section 62 was also approximately 78 inches. The support sections 56-62 each had a width, as viewed in FIG. 2 and measured parallel to an end surface 70, 72, 74 or 76 of the support section, of approximately 4 inches. The distance between the upper and lower surfaces 84 and 86 (FIG. 3) was also approximately 4 inches.

It should be understood that the aforementioned specific dimensions for the support structure 32 have been set forth herein merely for purposes of clarity of description and not for purposes of limiting the invention. It is contemplated that the support structure 32 may and probably will be constructed with different dimensions. It is believed that the dimensions of the support structure may vary with variations in the size of an article to be cast in the mold structure 12. Thus, the larger the mold structure 12, the larger is the support structure 32.

The support sections 56-62 may have different lengths. Thus, the support section 56 may be longer than the support section 58. The support sections 56 and 60 may have a combined length which is greater than the combined length of the support sections 58 and 62.

The support structure 32 may be considered as being inscribed within a spatial envelope formed by a polygon. In the specific embodiment of the support structure 32 having the configuration illustrated in FIG. 2 and the dimensions previously set forth herein, the support structure may be considered as being inscribed within a square spatial envelope, each side of which is 78 inches long. In this specific instance, the upper surface 84 of the support sections will have a surface area which is approximately 600 square inches. The area of the square spatial envelope within which the support structure is inscribed has an area of approximately 6,000 square inches.

In the specific embodiment of the invention illustrated in FIG. 2, the upper surface 84 of the support structure 32 has an area which is approximately 10% of the area of the polygon (square) spatial envelope within which the support structure is inscribed. The remainder of the area of the square spatial envelope is open space. It is contemplated that the support structure 32 may have an upper surface area which is between approximately five percent (5%) and approximately twenty-five percent (25%) of the area of a polygonal spatial envelope within which the support structure is inscribed. The remainder of the area of the polygonal spatial envelope will be open space. The support structure 32 touches the polygon in which it is inscribed at as many places as possible.

It should be understood that the support structure 32 may have a construction which is different than the illustrated construction. For example, the support structure 32 may have a greater or lesser number of support sections. As another example, the support sections 56-62 may have arcuately curving lower surfaces and/or side surfaces rather than the flat lower surfaces 86 and flat side surfaces 80 and 82. If the support sections 56-62 are provided with arcuately curving lower surfaces, the side surfaces 80 and 82 may be eliminated or substantially reduced in vertical (as viewed in FIG. 3) extent.

The support structure 32 functions as a chill plate. Accordingly, heat is transmitted from the mold structure 12 to the support structure 32. If desired, passages may be provided in the support structure 32 to conduct a flow of cooling fluid through the support structure. If cooling fluid passages are provided in the support structure, suitable cooling fluid conduits may be formed in or connected with the support rods 28. As was previously mentioned, the support rods 28 may be disposed outside the furnace assembly 16.

Mold Structure

The mold structure 12 (FIGS. 1 and 2) includes a base plate 90 which is disposed in engagement with and has the same configuration as the upper surface 84 (FIG. 3) of the support structure 32. The article mold sections 44 (FIGS. 1 and 2) extend upward from the base plate 90 and are fixedly secured to the base plate. The base plate 90 is coextensive with the upper side surface 84 of the support structure 32 and is fixedly secured to the support structure by suitable clamps and/or fasteners (not shown). If desired, pins may extend upwardly from the upper side 84 of the support sections 56-62 into openings in the base plate 90 to retard relative movement between the base plate and support structure 32.

The illustrated mold structure 12 has a single article mold section 44 disposed on the portion of the base plate 90 which overlies one of the support sections 56-62 of the support structure 32. However, the mold structure 12 may be formed with a greater number of article mold sections 44 on each of the support sections 56-62 of the support structure 32 if desired. An article mold section 44 may extend upward from the portion of the base plate 90 which overlies the central portion 66 of the support structure 32.

The mold structure 12 is integrally formed as one piece by repetitively dipping a wax pattern in a slurry of ceramic mold material in the manner disclosed in U.S. Pat. No. 4,955,423. However, it should be understood that the mold structure 12 may be formed in many different ways and could be utilized to form many different types of cast metal articles. In the illustrated embodiment of the mold structure 12, the article mold sections 44 are configured so as to cast blades or vanes for use in a turbine engine. However, the article mold sections 44 may be configured so as to cast any desired metal article.

Layer of Insulating Material

A layer 100 (FIGS. 1 and 3) of insulating material is provided above the body 22 of molten metal. The layer 100 of insulating material forms a baffle to block heat transfer to the body 22 of molten metal. Although the baffle provided by the layer 100 of insulating material facilitates maintaining a relatively large temperature differential between the furnace assembly 16 and the body 22 of molten meal, the layer of insulating material may be eliminated if desired.

The illustrated layer 100 of insulating material floats on the upper surface 102 of the body 22 of molten metal. The layer 100 of insulating material shields the body 22 of molten metal from the relatively hot environment of the furnace assembly 16. Thus, the layer 100 of insulating material retards heat transfer from the furnace assembly 16 and mold structure 12 to the body 22 of molten metal. This enables the body 22 of molten metal to be maintained a relatively low temperature during preheating of the mold structure 12 and during the pouring of molten metal into the mold structure.

The layer 100 of insulating material may be formed of many different materials. In the illustrated embodiment of the invention, the layer 100 of insulating material is formed of refractory particles which float on the body 22 of molten metal. However, it is contemplated that the layer 100 of insulating material may be formed in a different manner if desired. For example, the layer 100 of insulating material may be formed by hollow members which have a construction similar to any one of the constructions disclosed in U.S. Pat. Nos. 6,446,700 and 6,035,924.

If desired, the layer 100 of insulating material may be disposed above and spaced from the body 22 of molten metal. At least a portion of the layer 100 of insulating material may have a relatively rigid construction and have one or more openings through which the mold structure 12 and support structure 32 move. If this is done, the layer 100 of insulating material may be connected with the upper end portion of the container 20.

The layer 100 of insulating material may have any one of many known constructions. For example, it is contemplated that the layer 100 of insulating material may have a construction similar to any one of the constructions disclosed in U.S. Pat. No. 6,698,493. The disclosure in the aforementioned U.S. Pat. No. 6,698,493 is hereby incorporated herein in its entirety by this reference thereto.

Alternatively, the layer 100 of insulating material may have a relatively rigid base which extends around the mold structure 12. A plurality of flexible segments may extend from the rigid base into engagement with the mold structure 12. The flexible segments cooperate with the relatively rigid base of the layer 100 of insulating material to close space between irregular surfaces of the article mold sections 44 and the relatively rigid base. If this is done, the base of the layer 100 of insulating material may be supported on the support structure 32 during upward movement of the mold structure 12 into the furnace assembly 16. As the mold structure 12 moves downward from the furnace assembly 16, the relatively rigid base of the layer 100 of insulating material may be engaged by members (pins) connected with the furnace assembly 16 during downward movement of the mold structure 12 from the furnace assembly 16. These members (pins) would support the layer of insulating material. The layer 100 of insulating material may have the same construction and cooperate with the mold structure 12 in the same manner as disclosed in U.S. Pat. No. 6,827,124. The disclosure in the aforementioned U.S. Pat. No. 6,827,124 is hereby incorporated herein in its entirety by this reference thereto.

Assuming that the mold structure 12 is to be immersed in the body 22 of molten metal in the container 20 by lowering the support structure 32 through a layer of 100 (FIG. 1) of insulating material which floats on the body of molten metal, as the support structure 32 moves downward, the bottom of the support structure engages the floating layer of insulating material. The bottom surfaces 86 on the support sections 56-62 of the support structure 32 are effective to deflect the floating particles in the layer 100 of insulating material. As this occurs, the portions of the layer 100 of insulating material which are aligned with the spaces 52 (FIG. 2) between the support sections 56-62 of the support structure 32 are substantially undisturbed.

As the support structure 32 moves into engagement with the layer 100 of insulating material, only the portion of the layer 100 of insulating material which is aligned with the narrow support sections 56-62 and the central portion 66 of the support structure is engaged by the support structure. The portion of the insulating layer 100 which is engaged by the bottom side of the support structure 32 is deflected downwardly and sidewardly. The relatively large portions of the layer 100 aligned with the spaces 52 between the support sections 56-62 of the support structure 62 are not engaged by the support structure and are substantially undisturbed. This results in a relatively tight heat seal being maintained between the insulating layer 100 and the support structure 32 as the insulating layer is initially penetrated by the support structure. Therefore, there is minimal heat transfer from the furnace assembly 16 to the body 22 of molten metal.

As the support structure 32 continues to move slowly downward, the layer 100 of insulating material engages the side surfaces 80 and 82 on the support sections 56-62 to maintain a baffle of heat insulating material between the body 22 of molten metal in the container 20 and the hot furnace assembly 16. As the support structure moves still further downward, the body 22 of molten metal and the layer 100 of insulating material move inwardly over the base plate 90 of the mold structure 12. As this occurs, the layer 100 of insulating material moves into engagement with side portions 108 (FIG. 3) of the article mold sections 44 and across the upper surface of the base plate 90. This results in the layer 100 of insulating material establishing a baffle which extends around the article mold sections 44 and across the upper side surface of the base plate 90 of the mold structure 12. It should be noted that there is minimal disturbance of the layer 100 of insulating material by the support structure 32 because the support sections 56-62 of the support structure 32 are relatively narrow and can pass through the layer 100 of insulating material with minimum disturbance of the layer 100 of insulating material.

As the support structure 32 and mold structure 12 continue to be lowered, the body 22 of insulating material remains substantially intact until the gating system 46 moves downward into engagement with the upper side surface of the layer 100 of insulating material. This enables the layer 100 of insulating material to continue its function of providing a baffle to block heat transfer between the relatively hot furnace assembly 16 and the body 22 of molten metal as the mold structure is moved almost completely into the body 22 of molten metal. Since the arms of the gating system 46 are aligned with the support sections 56-62 of the support structure 32, there is also relatively little disturbance of the layer 100 of insulating material as the gating system 46 moves downward to and, if desired, through the insulating layer 100.

As the article mold portions 44 of the mold structure 12 move into the body 22 of molten metal, heat is transferred from the relatively hot molten metal in the article mold cavities 112 (FIG. 3) through the side portions 108 of the article mold portions 44 to the relatively cool body 22 of molten metal. As this occurs, the molten metal in the lower (as viewed in FIG. 3) end portion of the article mold cavity 112 begins to solidify at a level which is aligned with the upper surface 102 of the body 22 of molten metal, in the manner indicated schematically at 116 in FIG. 3. The metal in the article mold cavity 12 above the solidified metal 116 remains molten, in the manner indicated schematically at 118 in FIG. 3.

The metal in the article mold section 44 is directionally solidified upwardly in the article mold cavity 112. The metal in the article mold cavity may solidify with either a columnar grain or single crystal crystallographic structure. As this mold structure 12 continues to move into the body 22 of molten metal, the molten metal 118 in the article mold cavity 112 will solidify upwardly with the same crystallographic structure as the metal 116 in the lower portion of the article mold cavity 112.

Once the molten metal has solidified in the article mold cavity 112, the mold structure 12 is withdrawn from the body 22 of molten metal. This may be accomplished by lowering the body 22 of molten metal with the lower drive assembly 38 (FIG. 1), or raising the mold structure and framework 26 with the upper drive assembly 34 or by a combination of lowering the container 20 and body 22 of molten metal and raising the framework 26 and mold structure 12.

As the mold structure 12 is withdrawn from, the molten metal in the body 22, the molten metal passes through the open spaces 52 (FIG. 2) between the support section 56-62 of the support structure 32. At the same time, molten metal from the body 22 of molten (liquid) metal drains off of the mold structure 12. Due to the relatively large open spaces 52 (FIG. 2) between article mold sections 44, the liquid metal is easily drained off of the mold structure as the mold structure is moved out of the body 22 of molten metal.

In the foregoing description, it has been assumed that the support structure 32 and mold structure 12 are lowered into the body 22 of molten metal and are subsequently raised from the body 22 of molten metal. However, it should be understood that the mold structure 12 may be lowered from the furnace and then the body 22 of molten metal raised to immerse the mold structure 12 in the body 22 of molten metal. Similarly, the mold structure 12 may be removed from the body 22 of molten metal by lowering the body 22 of molten metal relative to the mold structure.

The upper drive assembly 34 is operable to both raise and lower the support structure 32 and mold structure 12 relative to the body 22 of molten metal. Similarly, the lower drive assembly 38 is operable to both raise and lower the container 20 holding the body 22 of molten metal relative to the support structure 32 and mold structure 12. The drive assemblies 34 and 38 may be simultaneously operated and/or sequentially operated.

Figure 4:
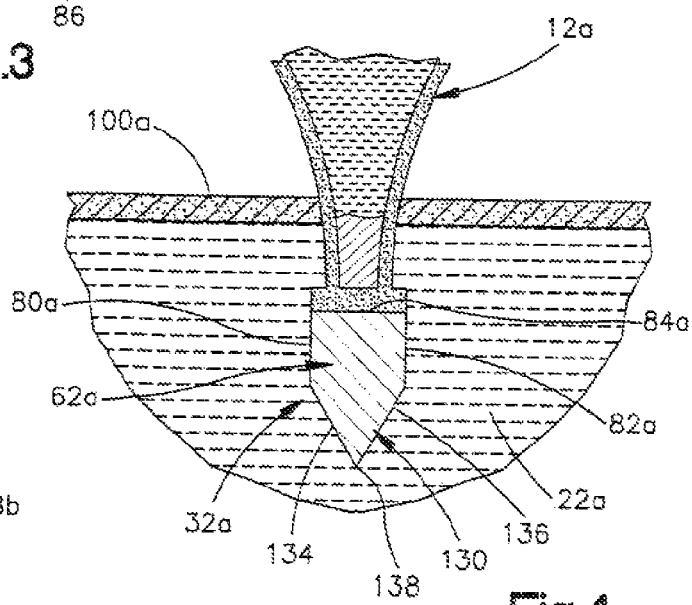
FIG. 4 is a fragmentary schematic sectional view, generally similar to FIG. 3, of a second embodiment of the support structure.

Embodiment of FIG. 4

In the embodiment of the invention illustrated in FIGS. 1-3, the layer 100 of insulating material is deflected by engagement with the bottom surface 86 on the support sections 56-62 when the mold structure 12 is lowered and/or the body 22 of molten metal is raised. In the embodiment of the invention illustrated in FIG. 4, the support sections of the support structure are tapered to facilitate minimizing disturbances of the body 22 of molten metal and/or the layer 100 of insulating material when the support structure enters the molten metal bath. Since the embodiment of the invention illustrated in FIG. 4 is generally similar to the embodiment of the invention illustrated in FIGS. 1-3, similar numerals will be utilized to designate similar components. The suffix letter "a" being added to the numerals of FIG. 4 to avoid confusion.

A mold structure 12*a* is disposed on a support structure 32*a*. The support structure 32*a* can be raised and lowered relative to a bath or body 22*a* of molten (liquid) metal in the manner previously described in conjunction with the embodiment of the illustrated in FIGS. 1-3. Assuming that the support structure 32*a* (FIG. 4) is being lowered to move the mold structure 12*a* into the bath or body 22*a* of molten metal, the support structure penetrates a layer 100*a* of insulating material.

To facilitate minimizing disturbances in the layer 100*a* of insulating material as it is penetrated by the support structure 22*a*, the support structure 32*a* has a tapered lower or leading end portion 130. The tapered leading end portion 130 penetrates the continuous layer 100*a* of insulating material and deflects the insulating material sidewardly as the support structure 32*a* moves downward through the layer 100*a* of insulating material into the body 22*a* of liquid metal. The tapered leading end portion 130 of the support structure 32*a* includes leading side surfaces 134 and 136 which intersect at a point 138.

Although only the tapered leading end portion 130 on the support section 62*a* has been illustrated in FIG. 4, it should be understood that the other support sections, corresponding to the support sections 56, 58 and 60 of FIG. 2, are similarly tapered. The support section 62*a* includes side surfaces 80*a* and 82*a* which extend upwardly (as viewed in FIG. 4) to a top surface 84*a*. The mold structure 12*a* rests on the top surface 84*a* of the support structure 32*a*.

If the insulating layer 100*a* is eliminated or positioned above and is spaced apart from the body 22*a* of molten metal, the tapered leading end portion 130 on the support structure 32*a* minimizes disturbance of the body of molten metal. The tapered leading end portion 130 pushes the molten metal aside with a smooth penetrating action. This smooth penetrating action begins as the support structure 32*a* initially engages the body 22*a* of molten metal and continues as the support structure is lowered further into the body of molten metal.

Figure 5:
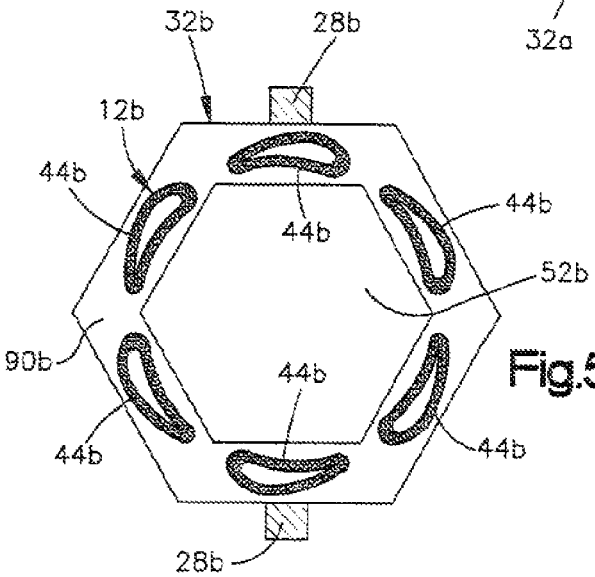
FIG. 5 is a schematic plan view, on a reduced scale, illustrating the relationship of a mold structure to a third embodiment of the support structure.

Embodiment of FIG. 5

In the embodiment of the invention illustrated in FIGS. 1-4, the support structure 32 has support sections 56-62 which extend outwardly from a central portion 66 of the support structure. In the embodiment of the invention illustrated in FIG. 5, the support structure forms a ring. Since the embodiment of the invention illustrated in FIG. 5 is generally similar to the embodiment of the invention illustrated in FIGS. 1-4, similar numerals will be utilized to designate similar components, the suffix letter "b" being associated with the numerals of FIG. 5 to avoid confusion.

A support structure 32*b* is utilized to support a mold structure 12*b*. The mold structure 12*b* includes a plurality of article mold sections 44*b* which are disposed on a base plate 90*b*. The base plate 90*b* is coextensive with and rests on the support structure 32*b*. The base plate 90*b* is held against movement relative to the support structure 32*b* by suitable clamps and/or fasteners (not shown).

The support structure 32*b* is connected to a pair of upright support rods 28*b* corresponding to the support rods 28 of FIG. 1. The support rods 28*b* are connected with an upper drive assembly similar to the drive assembly 34 of FIG. 1. The support structure 32*b* supports the mold structure 12*b* during relative movement between the support structure and a body of molten (liquid) metal, corresponding to the body 22 of molten metal disposed in the container 20 of FIG. 1.

The support structure 32*b* and mold structure 12*b* (FIG. 5) have an open space 52*b* which is disposed in a central portion of the ring formed by the support structure 32*b* and mold structure 12*b*. The open space 52*b* in the support structure 32*b* and mold structure 12*b* enables the mold structure to be moved into the body of molten metal, corresponding to the body 22 (FIG. 1) of molten metal, with minimal disturbance of the body of molten metal. When the mold structure 12*b* (FIG. 5) and support structure 32*b* are withdrawn from the body of molten metal, the open spaces in the mold structure and support structure facilitates separation of the molten metal in the body of molten metal from both the mold structure 12*b* and support structure 32*b*.

If desired, a layer of insulating material, corresponding to the layer 100 of FIG. 1, may be provided above the body of molten metal associated with the support structure 32*b*. The layer of insulating material retards heat transfer between the furnace assembly and the body of molten metal. The layer of insulating material may be omitted if desired.

The support structure 32*b* may have a tapered lower or leading end portion, corresponding to the tapered leading end portion 130 of FIG. 4. If the support structure 32*b* (FIG. 5) is provided with a tapered leading end portion, similar to the tapered leading end portion 130 of FIG. 4, disturbance of a layer of insulating material disposed above the body of liquid metal may be minimized as the support structure 32*b* and body of liquid metal are moved relative to each other to immerse the mold structure 12*b* in the body of liquid metal.

The illustrated support structure 32*b* has a polygonal configuration. Although the support structure has been illustrated herein as having six support sections, corresponding to the support sections 56-62 of FIG. 2, the support structure 32*b* may have either a greater or lesser number of support sections if desired. Although hexagonal the support structure 32*b* has been illustrated herein as having linear support sections which are interconnected to form a polygonal ring, the support structure 32*b* may have arcuate support sections. These arcuate support sections may be interconnected to form a circle or other configuration.

The support structure 32*b* may be considered as being inscribed within a spatial envelope formed by a hexagonal polygon having the same size as the outside of the support structure. The support structure 32*b* may have an upper surface area which is between approximately five percent (5%) and approximately twenty-five percent (25%) of the area of the hexagonal spatial envelope within which the support structure 32*b* is inscribed. The remainder of the area of the polygonal spatial envelope within which the support structure 32*b* is inscribed will be open space.

The illustrated support structure 32*b* has a hexagonal configuration. However, the support structure 32*b* may have a different configuration if desired. For example, the support structure 32*b* may have a rectangular configuration. Alternatively, the support structure 32*b* may have an octagonal configuration. As another example, the support structure 32*b* may have an annular configuration.

It is contemplated that the mold structure 12*b* and support structure 32*b* may be utilized with a layer of insulating material, corresponding to the layer 100 (FIG. 1) of insulating material. The layer of insulating material is disposed above the body of molten metal, corresponding to the body 22 (FIG. 1) of molten metal. The layer of insulating material may float on the body 22 of molten metal. Alternatively, the layer of insulating material may be disposed above and spaced from the body of molten metal.

Assuming that the mold structure 12*b* is to be immersed in the body of molten metal, that is, the body 22 of FIG. 1, by lowering the support structure 32*b* through a layer of insulating material which floats on the body of molten metal, the support structure engages the floating layer of insulating material. The bottom surfaces on the support structure 32*b* are effective to deflect the floating particles in the layer of insulating material corresponding to the layer 100 (FIG. 1) of insulating material. As this occurs the portion of the layer of insulating material aligned with the space 52*b* (FIG. 5) between portion of the support structure and between article mold sections 44*b* are substantially undisturbed.

As the support structure 32*b* moves into engagement with the layer of insulating material, only the portion of the layer of insulating material which is aligned with the narrow sections of the support structure 32*b* is engaged by the support structure. The portion of the layer of insulating material aligned with the space 52*b* is not engaged by the support structure 32*b* and is substantially undisturbed. This results in a relatively tight heat seal being maintained between the insulating layer and the support structure 32*b* as the insulating layer is penetrated by the support structure.

As the support structure 32 continues to move slowly downward, the insulating layer engages side surfaces of the mold sections 44*b*. This results in a baffle of insulating material, corresponding to the insulating material 100 of FIG. 1, being maintained between the body of molten metal, corresponding to the body 22 of molten metal in FIG. 1, and the furnace assembly. As the article mold portions 44*b* (FIG. 5) of the mold structure 12*b* move into the body of molten (liquid) metal, metal is directionally solidified in the article mold portions 44*b*.

The layer of insulating material may be disposed above and spaced from the body of molten metal. At least a portion of the layer of insulating material may have a relatively rigid construction and have one or more openings through which the mold structure 12*b* and support structure 32*b* move. If this is done, the layer of insulating material may be connected with the upper end portion of a container which holds the body of molten metal in which the mold structure 12*b* is immersed.

Once the molten metal in the article mold portions 44*b* has solidified, the mold structure 12*b* is withdrawn from the body of molten metal, corresponding to the body 22 of molten metal in FIG. 1. As this occurs, the molten metal drains off the mold structure 12*b*. The open space 52*b* between the mold portions 44*b* facilitates drainage of the molten metal from the outside of the mold structure 12*b* and the support structure 32*b*.

Figure 6:
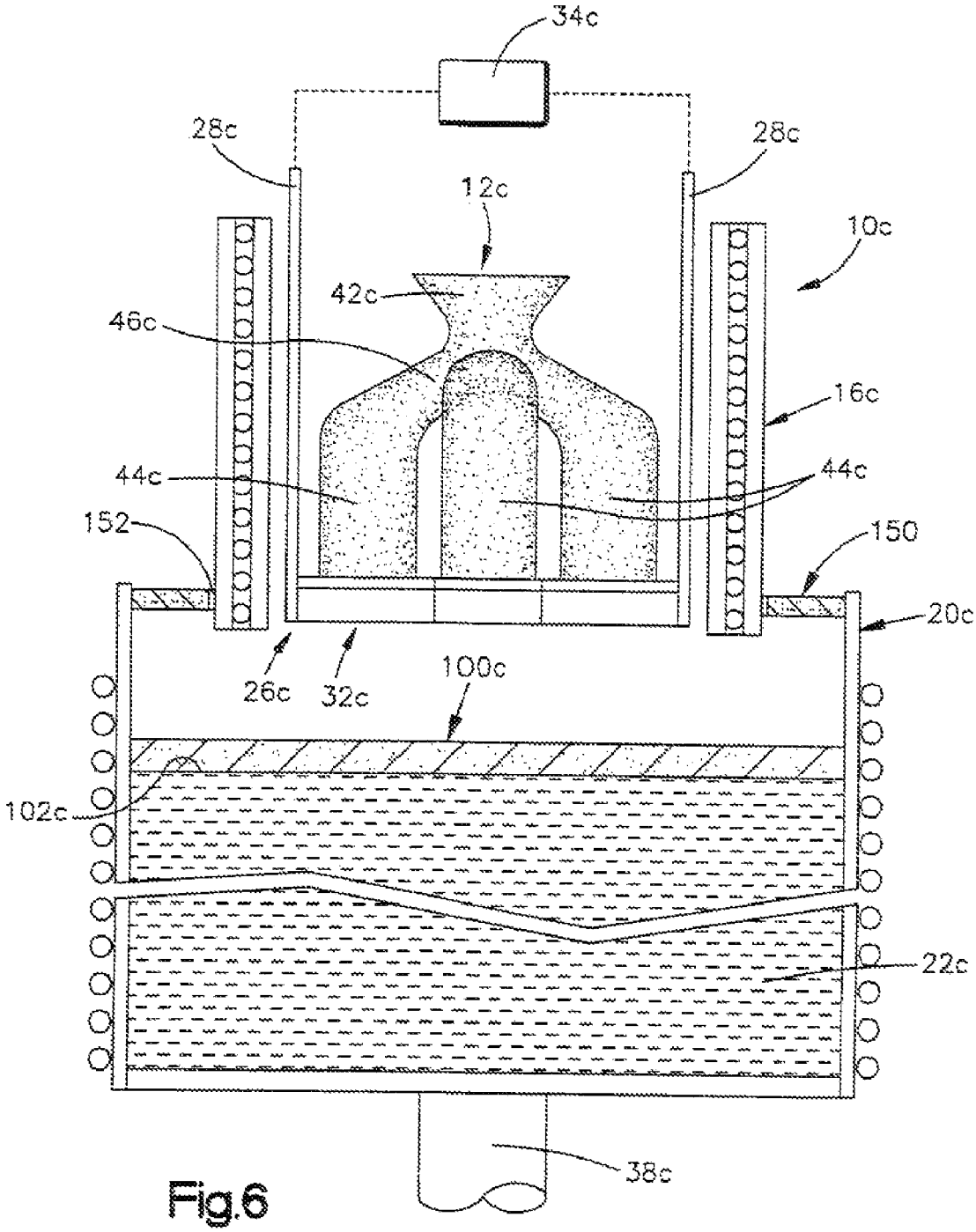
FIG. 6 is a schematic illustration depicting the manner in which a baffle may be positioned between a container holding the body of molten metal and a furnace assembly.

Embodiment of FIG. 6

In the embodiment of the invention illustrated in FIGS. 1-5, there is no baffle between the container 20 and the furnace assembly 16. Since there is space between the container 20 and the furnace assembly 16, heat can be transferred through this space. In the embodiment of the invention illustrated in FIG. 6, a baffle is disposed between the container and the furnace assembly to retard heat loss. Since the embodiment of the invention illustrated in FIG. 6 is generally similar to the embodiments of the invention illustrated in FIGS. 1-5, similar numerals will be utilized to designate similar components, the suffix letter "c" being associated with the numerals of FIG. 6 to avoid confusion.

A casting apparatus 10*c* (FIG. 6) is utilized to cast metal articles in a mold structure 12*c*. The casting apparatus 10*c* includes a furnace assembly 16*c* in which a first molten metal is poured into the ceramic mold structure in a known manner. Directly beneath the furnace assembly 16*c* is a container 20*c* which holds a body 22*c* of a second molten (liquid) metal.

A framework 26*c* supports the mold 12*c* for movement to and from the furnace assembly 16*c* and for movement to and from the body 22*c* of molten metal. The framework 26*c* includes a plurality of support rods 28*c* and a mold support structure 32*c*. The support rods 28*c* may be disposed outside the furnace assembly 16*c* if desired.

As was previously mentioned, the support structure 32*c* functions as a chill plate. The support rods 28*c* are connected with an upper drive assembly 34*c* and with the mold support structure 32*c*. The upper drive assembly 34*c* is operable to raise and lower the framework 26*c* relative to the furnace assembly 16*c* and container 20*c* holding the body 22*c* of molten metal.

A lower drive assembly 38*c* is connected with the container 20*c* which holds the body 22*c* of molten metal. The lower drive assembly 38*c* is operable to raise and lower the container relative to the furnace assembly 16*c*. The upper and lower drive assemblies 34*c* and 38*c* may be operated simultaneously and/or sequentially to raise and/or lower the framework 26*c* and/or container 20*c* holding the body 22*c* of molten metal.

While the mold structure 12*c* is supported in a furnace 16*c* on the framework 26*c*, in the manner previously described in conjunction with the embodiments of the invention illustrated in FIGS. 1-5, the mold structure is preheated to a desired temperature. Molten metal is then poured into a pour cup 42*c* which is connected with article molds 44*c* in the mold structure 12*c* by a gating system 46*c*. The molten metal with which the mold structure 12*c* is filled is a nickel-chrome super alloy which melts at a temperature which is greater than 3,000 degrees Fahrenheit. Of course, the mold structure 12*c* may be filled with a different molten metal which melts at a different temperature.

A layer 100*c* (FIG. 6) of insulating material is provided above the body 22*c* of molten metal. The layer 100*c* of insulating material forms a baffle to block heat transfer to the body 22*c* of molten metal. Although the baffle provided by the layer 100*c* of insulating material facilitates maintaining a relatively large temperature differential between the furnace assembly 16*c* and the body 22*c* of molten metal, the layer of insulating material may be eliminated if desired.

The illustrated layer 100*c* of insulating material floats on the upper surface 102*c* of the body 22*c* of molten metal. The layer 100*c* of insulating material shields the body 22*c* of molten metal from the relatively hot environment of the furnace assembly 16*c*. Thus, the layer 100*c* of insulating material retards heat transfer from the furnace assembly 16*c* and mold structure 12*c* to the body 22*c* of molten metal.

The layer 100*c* of insulating material may have any of the constructions previously described herein. Although the layer 100*c* of insulating material is supported by floating on the body 22*c* of molten metal, the layer of insulating material may be supported in a different manner if desired. For example, the layer of insulating material may be supported by the container 20*c* and be above and spaced apart from the body 22*c* of molten metal.

In accordance with a feature of the embodiment of the invention illustrated in FIG. 6, a baffle 150 is disposed between the container 20*c* which holds the body 22*c* of molten metal and the furnace assembly 16*c*. The baffle 150 is disposed above and is spaced from the layer 100*c* of insulating material.

The rigid baffle 150 is fixedly connected to the upper end portion of the container 26*c* and extends radially inwardly from a cylindrical side wall of the container 20*c* toward the generally cylindrical furnace assembly 16*c*. The furnace assembly 16*c* is disposed in a circular central opening 152 in the baffle 150. The opening 152 has a slightly larger diameter than, the exterior of the furnace assembly 16*c* to enable the container 20*c* to move vertically relative to the furnace assembly 16*c*. Although the illustrated baffle 150 has an annular configuration, the baffle may have a different configuration which is a function of the configuration of the container 20*c* and/or furnace assembly 16*c*.

CONCLUSION

The present invention relates to a new and improved method of casting metal articles. The method includes providing a support structure 32 having a plurality of support sections 56-62. Article mold sections 44 are positioned on the support sections 56-62. Article mold cavities 112 in the article mold sections 44 are filled with a first molten metal which is at a first temperature.

The support sections 56-62 and a body 22 of a second molten metal are moved relative to each other. The body 22 of a second molten metal is at a temperature which is less than the first temperature of the first molten metal in the article mold cavities 112. Spaces 52 extending between side surfaces 80, 82 of the support sections 56-62 and between side portions of the article mold sections 44 are filled with the second molten metal.

If desired, a layer 100 of insulating material may be provided above an upper side 102 of the body 22 of a second molten metal. Portions of the layer 100 of insulating material are aligned with spaces 52 extending between side surfaces 80, 82 of the support sections 56-62. These portions of the layer 100 of insulating material extend across spaces between the support sections 56-62 and extend across spaces between portions of the article mold sections 44 during at least a portion of the relative movement between the support sections 56-62 and body 22 of molten metal. A baffle 150 may be provided between the container 20 holding the body 22 of a second molten metal and the furnace assembly 16.

The present invention has a plurality of different features which are advantageously utilized together in the manner described herein. However, it is contemplated that the features may be utilized separately and/or in combination with features from the prior art. For example, the layer 100 of insulating material may be formed by hollow bodies which float on the body 22 of liquid metal. Alternatively, the layer 100 of insulating material may be spaced from the body 22 of liquid metal. If desired the layer 100 of insulating material may be omitted.

Having described the invention, the following is claimed:

1. A method of casting metal articles, said method comprising the steps of providing a support structure having a plurality of interconnected support sections, positioning a plurality of article mold sections on the plurality of support sections with side portions of the article mold sections extending upward from the support sections, at least partially filling article mold cavities in the article mold sections with a first molten metal which is at a first temperature while the article mold sections are supported by the support sections, thereafter, moving the support sections and a body of a second molten metal relative to each other while the body of a second molten metal is at a second temperature which is less than the first temperature, and filling space extending between the support sections and between side portions of the article mold sections with the second molten metal which forms a portion of the body of molten metal during performance of said step of moving the support sections and the body of a second molten metal relative to each other, wherein each of the support sections extends outwardly from a central portion of the support structure so that a space extending between adjacent support sections increases in a direction extending outwardly from the central portion of the support structure.

2. A method as set forth in claim 1 further including the steps of solidifying the first molten metal in the article mold cavities during performance of said step of moving the support sections and body of molten metal relative to each other and while the article mold sections are supported by the support sections.

3. A method as set forth in claim 1 further including the step of moving the support sections and the body of a second molten metal relative to each other for a second time, and at least partially emptying space extending between the support sections and between side portions of the article mold sections of the second molten metal during performance of said step of moving the support sections and the body of a second molten metal relative to each other for a second time.

4. A method as set forth in claim 1 further including the step of providing a layer of insulating material above the body of a second molten metal, said step of moving the support sections and the second body of molten metal relative to each other includes deflecting first portions of the layer of insulating material aligned with the support sections and leaving second portions of the layer of insulating material to extend across space between the support sections and to extend across space between side portions of the article mold sections during at least a portion of the relative movement of the support sections and body of molten metal relative to each other after deflecting the first portions of the layer of insulating material.

5. A method as set forth in claim 4 wherein the step of providing a layer of insulating material above the body of a second metal includes floating the layer of insulating material on an upper surface of the body of a second molten metal.

6. A method as set forth in claim 4 wherein said step of deflecting first portions of the layer of insulating material includes engaging the layer of insulating material and deflecting the first portions of the insulating material under the influence of force transmitted from the support sections to the first portions of the layer of insulating material.

7. A method as set forth in claim 6 wherein lower surfaces on the support sections extend parallel to upper surfaces on the support sections and said step of deflecting first portions of the layer of insulating material includes applying force against an upper side of the layer of insulating material with the lower surfaces on the support sections.

8. A method as set forth in claim 6 wherein lower surfaces on the support sections include side surface areas which extend transversely to the upper surfaces and intersect to provide a lower portion of each of the support sections with downwardly tapering configuration, said step of deflecting portions of the layer of insulating material includes deflecting insulating material in one direction with a first side surface area on the lower portion of one of the support sections and deflecting insulating material in a second direction with a second side surface area on the lower portion of said one of the support sections.

9. A method as set forth in claim 4 further including the step of retarding heat transfer with a baffle disposed between a container which holds the body of a second molten metal and a furnace assembly with the baffle disposed above and spaced from the layer of insulating material.

10. A method as set forth in claim 1 wherein the support structure is disposed in a spatial envelope having a polygonal configuration and occupies between five percent (5%) and twenty-five percent (25%) of the area contained within the polygon forming the spatial envelope.

11. A method as set forth in claim 1 further including the step of blocking heat transfer with a baffle which is mounted on an upper end portion of a container which holds the body of a second molten metal.

12. A method as set forth in claim 11 further including the step of further blocking heat transfer with a layer of insulating material disposed on the body of a second molten metal.

* * * * *